US005643098A

United States Patent [19]

Monahan et al.

[11] Patent Number: 5,643,098

[45] Date of Patent: Jul. 1, 1997

[54] GOLF PUTTER TRAINING TOOLS

[76] Inventors: Deanna J. Monahan, 2545 N. 22th Dr., Phoenix, Ariz. 85009; Paula A. Brooks, 5233 W. Harmont Dr., Glendale, Ariz. 85302

[21] Appl. No.: 574,294

[22] Filed: Dec. 18, 1995

[51] Int. Cl.[6] ..... A63B 69/36

[52] U.S. Cl. ..... 473/230

[58] Field of Search ..... 473/226, 230, 473/313, 328, 340

[56] References Cited

U.S. PATENT DOCUMENTS 3,220,730 11/1965 Fine ..... 473/230
3,319,964 5/1967 Steinberg ..... 473/230
4,688,799 8/1987 Johnson ..... 473/230
5,172,915 12/1992 Flis ..... 473/230
5,207,721 5/1993 Lobdell ..... 473/230

*Primary Examiner*—William H. Grieb
*Attorney, Agent, or Firm*—Martin L. Stoneman

[57] ABSTRACT

This invention provides golf putter training tools for training a golfer's putting stroke. These golf putter training tools assist a golfer in making the putting stroke flat and in a straight "sweeping" line. A wheel, attached to the putter body, is provided adjacent each end of the putter and constructed to roll when the proper putting motion is used. The wheels (provided either as a putter part or as an add-on) extend slightly below the bottom surface of the putter and may include sharp portions along their circumference to impede other than straight rolling.

10 Claims, 3 Drawing Sheets

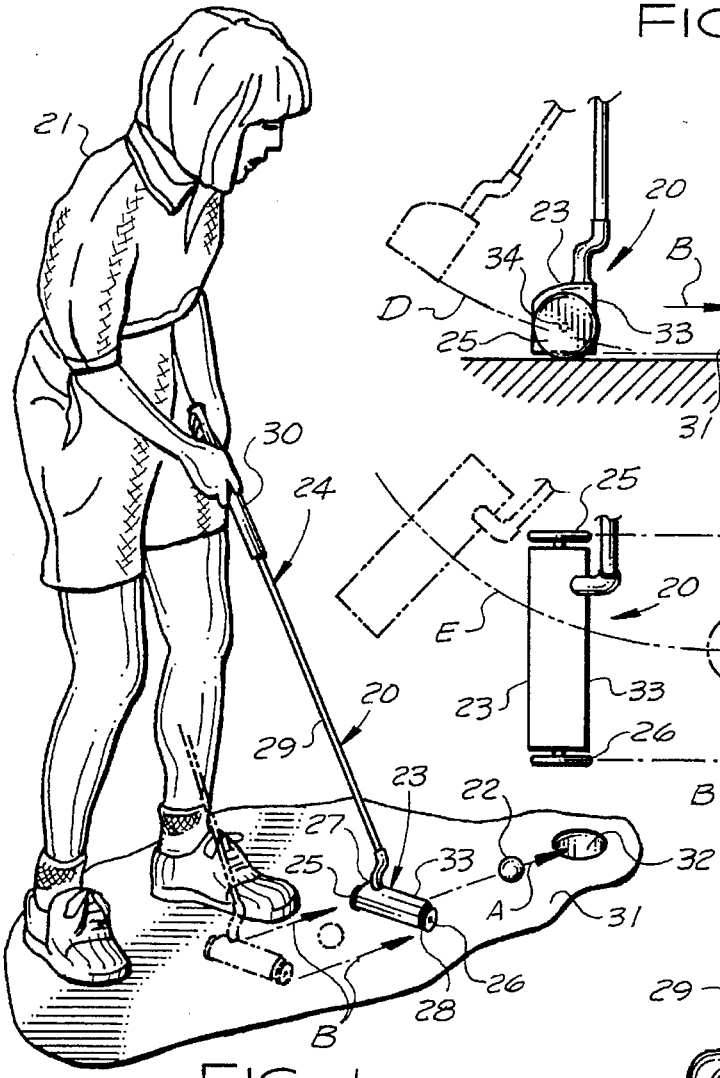
FIG. 1
FIG. 2
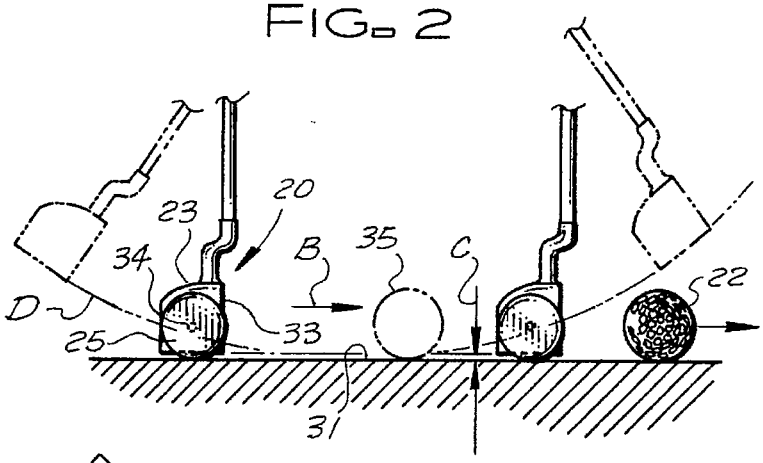
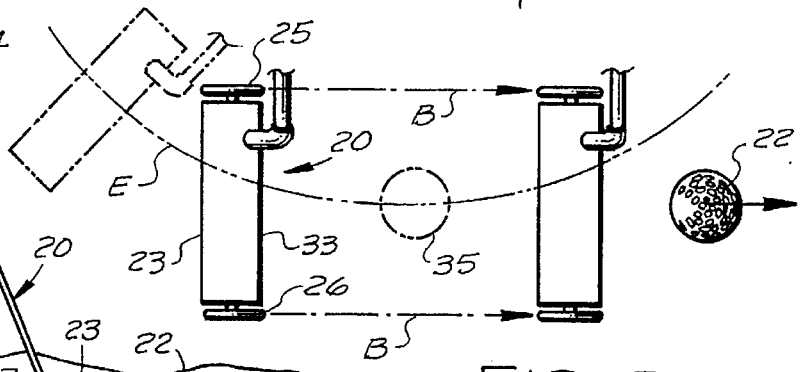
FIG. 3
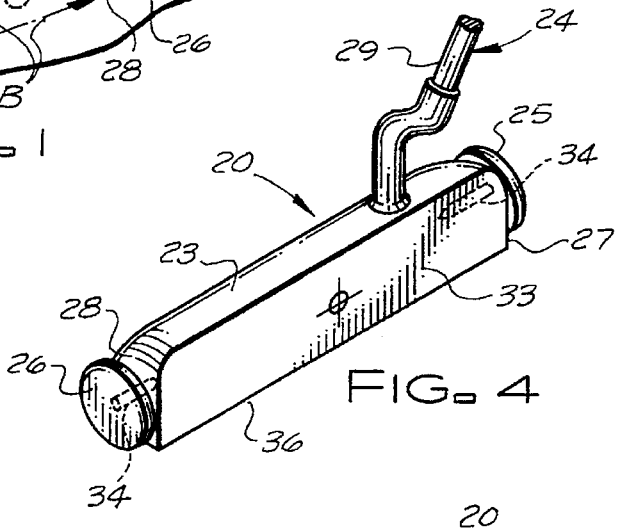
FIG. 4
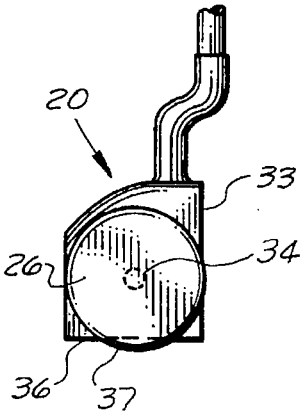
FIG. 6
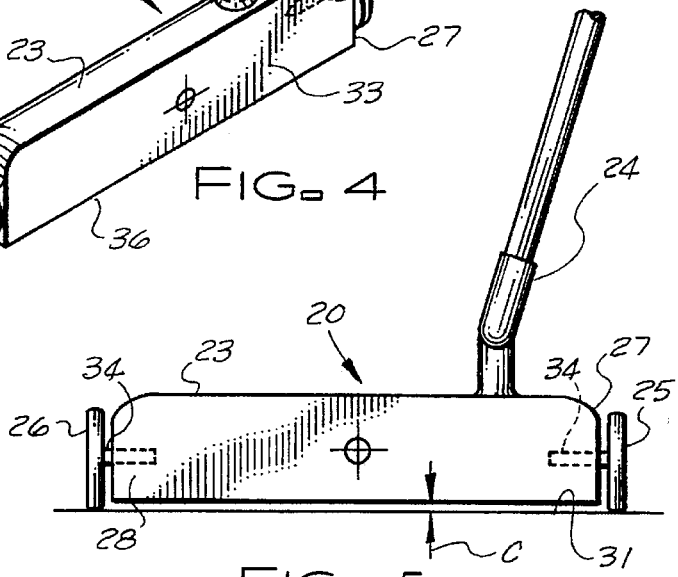
FIG. 5

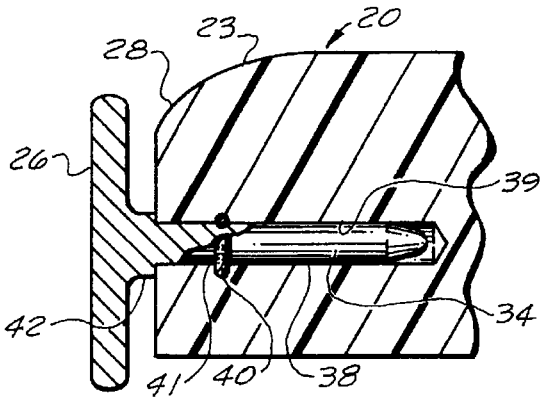
FIG. 7
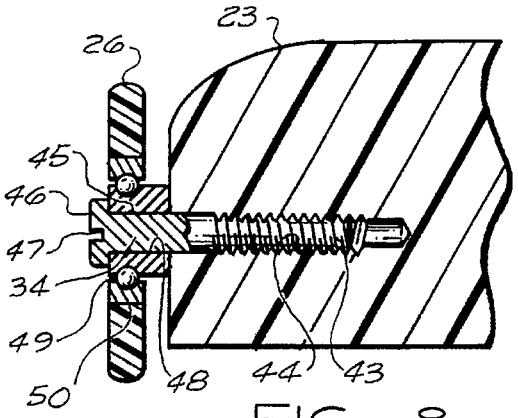
FIG. 8
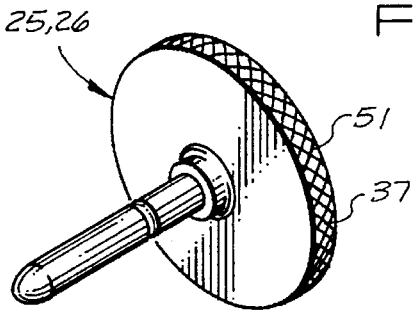
FIG. 9
FIG. 10
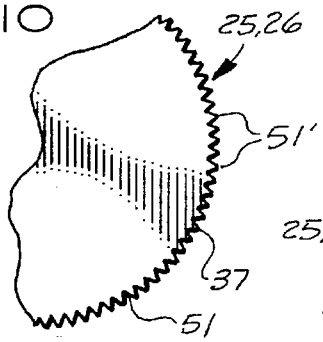
FIG. 12
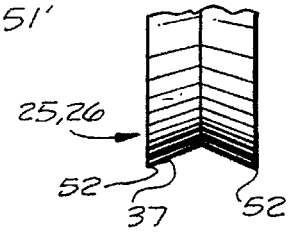
FIG. 11
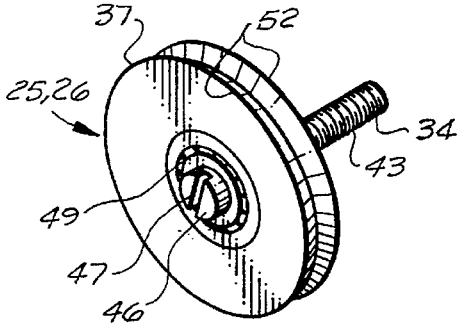
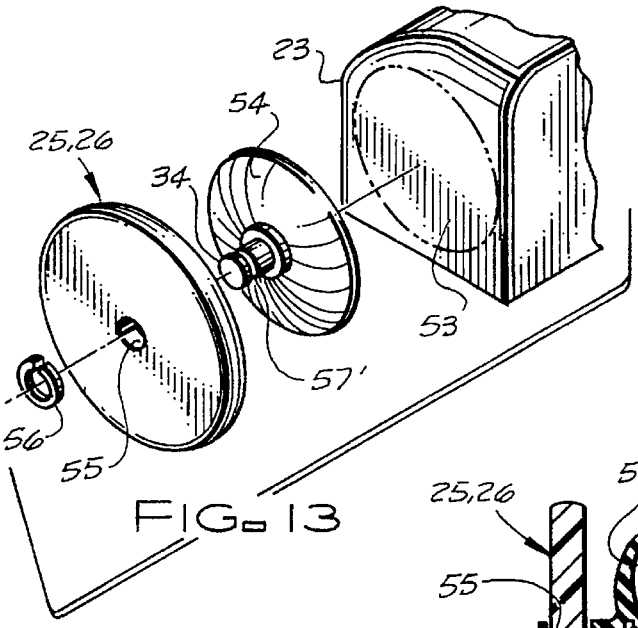
FIG. 13
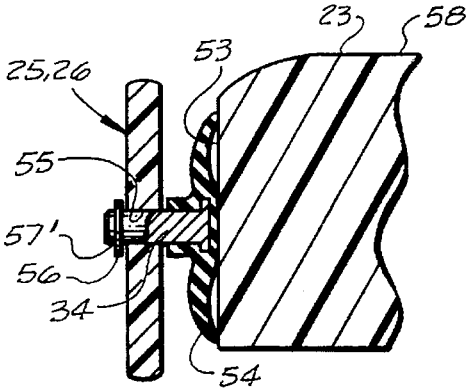
FIG. 14

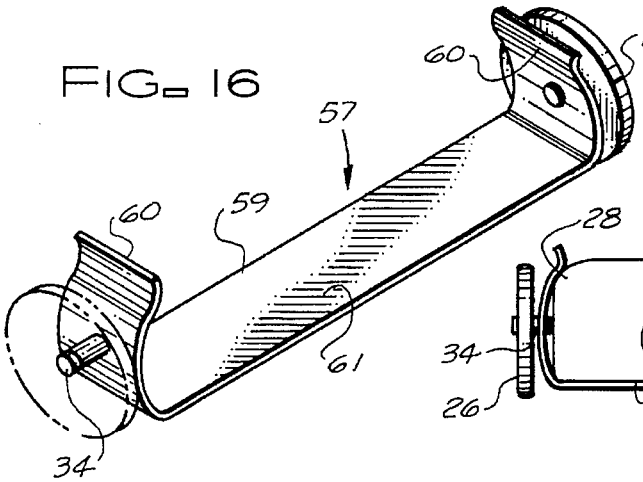
FIG. 16
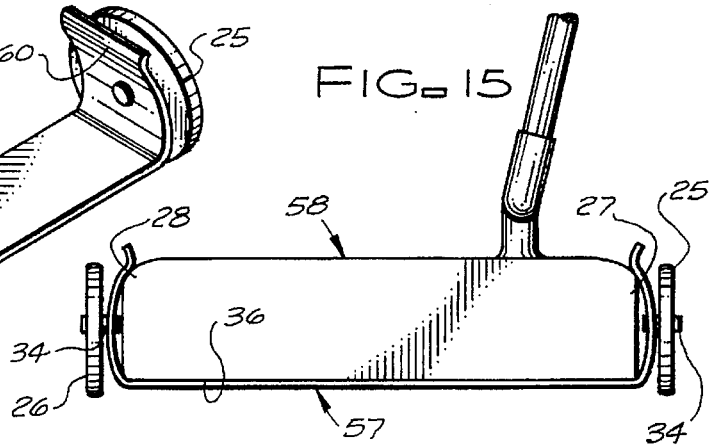
FIG. 15
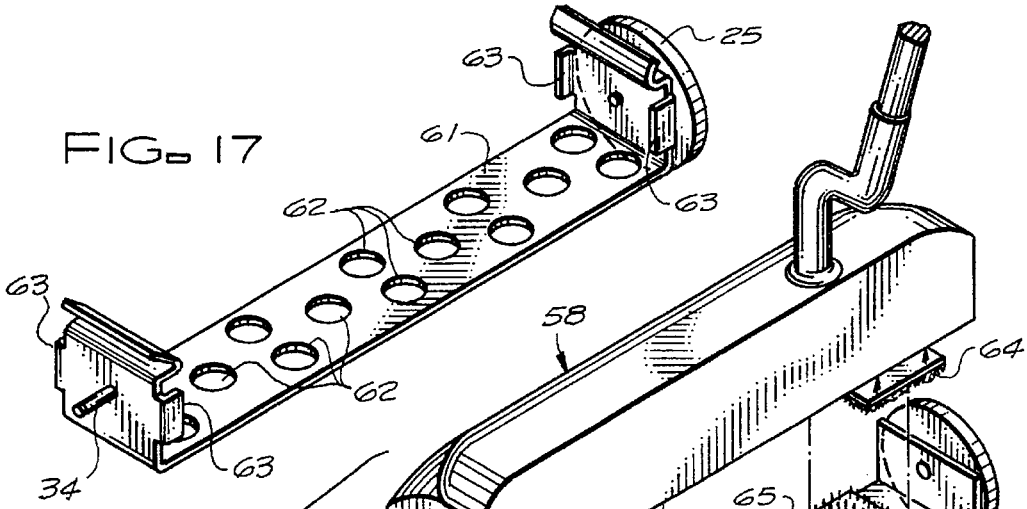
FIG. 17
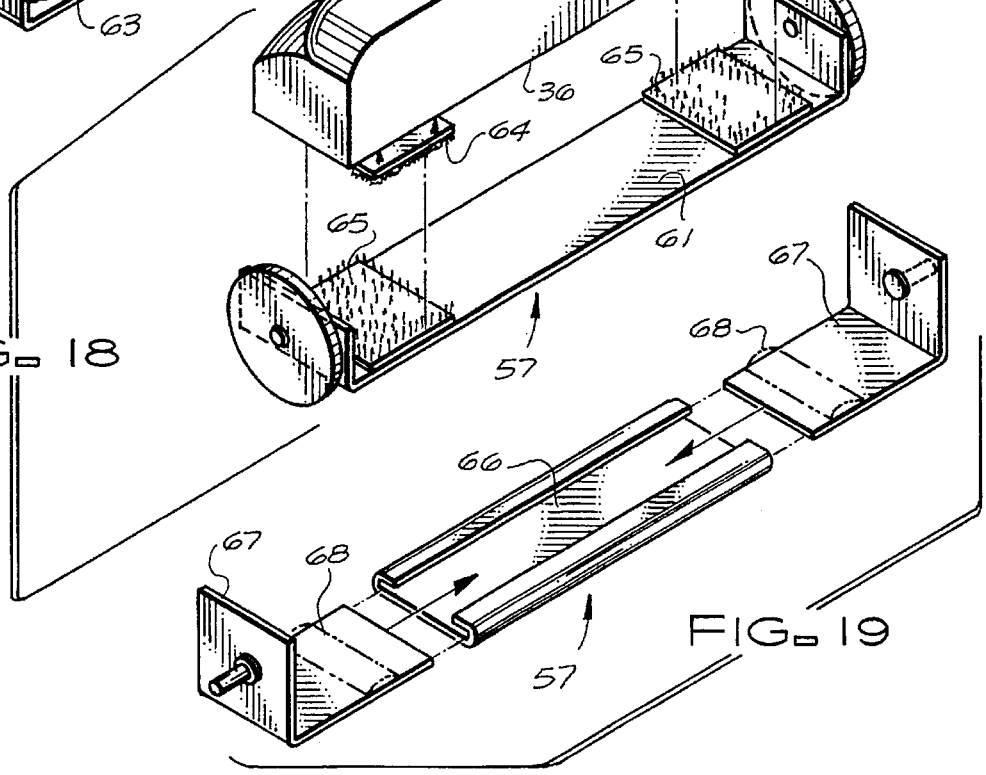
FIG. 18
FIG. 19

GOLF PUTTER TRAINING TOOLS

BACKGROUND OF THE INVENTION

1. Field of the Invention

This invention relates to providing golf putter training tools for training a golfer's putting stroke. More particularly, this invention concerns golf putter training tools for assisting a golfer in making the putting stroke flat and in a straight line.

2. Description of the Prior Art

Typically, in playing golf, a poor putter may make one or both of two kinds of errors in form.

One such error is that the golfer, in swinging back the putter prior to the hit, lifts up the putter as in a normal swing with a wood or iron golf club; and this type of golfer often also lifts up the putter as soon the golf ball is struck in putting. These "not-flat" errors are frequent in spite of the fact that the standard wisdom in putting is to move the putter in a flat "sweeping" motion.

Another such error is that the golfer turns the golfer's body while putting, and in the same way, again, as if in a normal swing with a wood or iron golf club. So, typically, such golfer, even if "sweeping" the putter head in a flat plane (thus not making the first kind of error mentioned above), brings back the putter head in an arc preparatory to the hit; and this type of golfer also follows through after the hit in an arc. These "not-straight" errors are frequent in spite of the fact that the standard wisdom in putting is to move the putter in a straight line through the hitting area of the putt (including before the putt hit and after the putt hit). Since a "good" putting motion is so different from a "good" wood-club swing or iron-club swing, it would be helpful to provide a tool or device to assist in training golfers to feel the difference and to practice doing putting with a flat and straight "sweeping" motion.

OBJECTS OF THE INVENTION

A primary object of the present invention is to fulfill the above-mentioned training need by the provision of such devices and tools for use in training golf putting. A further primary object of the present invention is to provide such a tool or device which is efficient, inexpensive, and handy. In addition, it is a primary object of this invention to provide such tool in connection with, and making use of, currently-used putters. Other objects of this invention will become apparent with reference to the following invention descriptions.

SUMMARY OF THE INVENTION

According to a preferred embodiment of the present invention, this invention provides, a golf putter training tool, for training a user's putting stroke along a putting surface, comprising, in combination: golf putter means comprising golf putter shaft means, and putter body means including a front putting portion, a bottom portion, and a pair of end portions; connected to such putter body means and situate adjacent a first such end portion, first wheel means constructed and arranged to roll forward during a such putting stroke; such golf putter training tool being constructed and arranged to assist a such user in making such putting stroke flat and in a straight line. Further provided is such a golf putter training tool further comprising, connected to such putter body means and situate adjacent a second such end portion, second wheel means constructed and arranged to roll forward during a such putting stroke. Even further, this invention provides such a golf putter training tool further comprising wheel axis means having an axis of rotation, such first wheel means and second wheel means both having a same radius and being constructed and arranged to rotate about such axis of rotation. Still further provided is such a golf putter training tool wherein such radius of such first and second wheel means is larger than a distance from such bottom portion to such axis of rotation.

Additionally, according to the present invention, there is provided such a golf putter training tool wherein such wheel axis means comprises a first wheel support means attached to such first end portion and a second wheel support means attached to such second end portion; and, further, wherein such first wheel means is rotatably attached to such first wheel support means and such second wheel means is rotatably attached to such second wheel support means; and, further, wherein such first and second wheel means each comprise a circumferential edge constructed and arranged to impede during rotation other than straight line travel; and, further, wherein each such circumferential edge comprises sharp portions constructed and arranged to partially embed each such wheel means in such putting surface.

Moreover, according to a preferred embodiment of the present invention, there is provided such a golf putter training tool further comprising unitary frame means removably attachable to such putter body means, such first and second wheel means being attached to such unitary frame means; and, further, wherein such unitary frame means is removably attached to such putter body means by spring clip means; and, further, wherein such unitary frame means is removably attached to such putter body means by velcro-type means; and, further, wherein such unitary frame means is constructed and arranged to be selectively extensible to accommodate the distance from such first end portion of such putter body to such second end portion.

Also, according to a preferred embodiment thereof, this invention provides, for use in training a user's putting stroke along a putting surface, a putter training device add-on, for attachment to putter body means including a front putting portion, a bottom portion, and a pair of end portions, such putter training device add-on comprising, in combination: frame means constructed and arranged for attachment to such putter body means in such manner as to extend from a first of such end portions to a second of such end portions; rotatably mounted to a first end of such frame means, first wheel means; and, rotatably mounted to a second end of such frame means, second wheel means. Further, this invention provides such a putter training device add-on constructed and arranged so that, when such putter training device add-on is attached to a such putter body means, such first and second wheel means will roll forward during a such putting stroke. Even further provided is such a putter training device add-on wherein such frame means comprises wheel axis means having an axis of rotation, and such first wheel means and second wheel means each having an essentially equal radius and being constructed and arranged to rotate about such axis of rotation.

Still further, this invention provides such a putter training device add-on constructed and arranged so that, when such putter training device add-on is attached to a such putter body means, such radius of such first and second wheel means is larger than a distance from such bottom portion of such putter body means to such axis of rotation; and, further, wherein such frame means is constructed and arranged for attachment to such putter body means at each of such end portions; and, further, wherein such frame means is constructed and arranged for attachment to such putter body means along such bottom portion; and, further, wherein such frame means is constructed and arranged to be selectively extensible to accommodate the distance from such first end portion of such putter body to such second end portion.

And, additionally, according to a preferred embodiment of the present invention, there is provided, for use in training a user's putting stroke along a putting surface, a putter training device add-on, for attachment to putter body means including a front putting portion, a bottom portion, and a pair of end portions, such putter training device add-on comprising, in combination: suction-cup means, of the type having a central axis, for attaching such putter training device add-on to a such end portion of a such putter body means; and, rotatably mounted to such suction-cup means about such central axis, wheel means. Further provided by this invention is such a putter training device add-on constructed and arranged so that, when such putter training device add-on is attached to a such putter body means, such radius of such wheel means is larger than a distance from such bottom portion of such putter body means to such central axis.

BRIEF DESCRIPTION OF THE DRAWINGS

FIG. 1 illustrates pictorially the preferred embodiment of a golf putter with wheels according to the present invention and being used by a golfer.

FIG. 2 is an illustrative elevation view of the preferred embodiment in use.

FIG. 3 is an illustrative plan view of the preferred embodiment in use.

FIG. 4 is a perspective view of the preferred embodiment.

FIG. 5 is a front elevation view of the preferred embodiment.

FIG. 6 is an end elevation view of the preferred embodiment.

FIG. 7 is a partial cross-sectional view of the preferred embodiment.

FIG. 8 is a partial cross-sectional view of an alternate construction of the preferred embodiment.

FIG. 9 is a perspective view of an alternate construction of the wheel portion of the preferred embodiment.

FIG. 10 is a partial end view of another alternate construction of the wheel portion of the preferred embodiment.

FIG. 11 is a perspective view of another alternate construction of the wheel portion of the preferred embodiment.

FIG. 12 is a partial front view of the alternate construction of the wheel portion of the preferred embodiment of FIG. 11.

FIG. 13 is an exploded perspective view of an alternate embodiment.

FIG. 14 is a partial cross-sectional view of the alternate embodiment illustrated in FIG. 13.

FIG. 15 is a front view of a another alternate embodiment.

FIG. 16 is perspective view of the alternate embodiment illustrated in FIG. 15.

FIG. 17 is perspective view of an alternate construction of the alternate embodiment of FIG. 15.

FIG. 18 is perspective view of yet another alternate embodiment.

FIG. 19 is perspective view of yet another alternate embodiment.

DETAILED DESCRIPTION OF A PREFERRED EMBODIMENT AND THE BEST MODE OF PRACTICE

FIG. 1 illustrates pictorially the preferred embodiment of a golf putter training tool 20 according to the present invention and being used by a golfer 21. Components of the golf putter training tool 20 include putter body means embodied by the putter body 23. Wheel means are embodied by a wheel 25 attached at the heel end portion 27 (of putter body 23) and a second wheel 26 (with the same diameter as wheel 25) attached at the toe end portion 28. Golf putter training tool 20 further includes shaft means embodied by a handle 24 comprised of a shaft 29 and grip 30. The golf putter training tool 20 is used as a training aide in developing proper putting motions. When hitting a golf ball in a direction towards and hopefully into a cup, the surface of the putter which strikes the ball needs to meet various criteria relating to placement location, direction of movement, and striking angles in both horizontal and vertical planes, as well as other factors such as speed, impact force, etc.

In the illustration of FIG. 1, a preferred embodiment of a golf putter training tool 20 has just completed striking the golf ball 22, and the golf ball 22 is rolling along the putting surface, green 31, towards cup 32. The direction A of golf ball 22 travel (discounting environment and green 31 conditions) was established at the point of being impacted by the front putting portion 33 of the golf putter training tool 20. The proper flat, straight, "sweeping" movement across the green 31 of the golf putter training tool 20 is indicated by arrows B. The body stance and motions of the golfer 21 required to deliver correct movement of the putter may be learned by allowing the wheels 25 and 26 to track over the surface of the green 31 to position the front putting portion 33 of the putter body 23 of the golf putter training tool 20 to contact the golf ball 22 with a favorable hit. These factors relating to movement and stance of the golf putter training tool's 20 putter body 23 are further described in FIGS. 2 and 3.

Without the benefit of the wheel means of the present invention, a conventional putter's movement relies only on the golfer's motions transferred through the grip 30, the shaft 29 and to the putter body 23. Once the golfer 21 has learned appropriate putting techniques through the enhanced action of the golf putter training tool 20, the wheels 25 and 26 may be removed, thus transforming the golf putter training tool 20 into a conventional putter. This training aide may be metaphored by the training wheels on a beginners bicycle.

FIG. 2 illustrates in elevation view the preferred embodiment of a golf putter training tool 20 in motion in a vertical plane. Movement B of the putter body 23 is maintained at a constant height C (preferred to be about ¼") above the surface of the green 31. This is established by the wheels 25 and 26 (each having a preferred diameter of about 1" to 1½") rolling across the green 31 and supporting the putter body 23 at a fixed elevation. The wheels 25 and 26 rotate freely about axles 34 located (at a vertical position constrained by the preferred wheel diameters and height C) at each end portion of the putter body 23. The golfer's goal is to develop a feel for consistent appropriate height above green 31 surface and to AVOID "swinging" the putter in an arc D as shown by dotted lines. When the front putting portion 33 of the putter body 23 impacts the golf ball 22 (at point of impact 35) while moving parallel to (i.e., "sweeping") the green 31, the golf ball's movement is directed straight forward with a greater accuracy and consistency.

Shown in plan view in FIG. 3 is an illustration of the enhanced straight line tracking of the golf putter training tool 20. As the putter body 23 rolls forward (as previously described) the wheels 25 and 26 tend to assist the golfer in moving the putter body 23 in a straight line as shown by arrows B. This motion is shown in contrast to the undesired horizontal arc E which is produced by the natural tendency of the golfer's body to rotate while "swinging" (as with using the other golf clubs) the putter. At the point of impact 35, the putter body 23 should be moving forward in a straight line in the same direction as which the golf ball 22 is desired to travel. Additionally, the front putting portion 33 at impact with the golf ball 22 should be positioned at a right angle, i.e., perpendicular, to the desired direction of travel of golf ball 22. The portions of wheels 25 and 26 which are in contact with the surface of the green 31 tend to act as runners, guiding the putter body in a straight line.

Shown in FIG. 4 is a partial enlarged perspective view of a preferred embodiment of the golf putter training tool 20. As shown, the golf putter training tool 20 consists of a putter body 23 with front putting portion 33 to which is attached a handle 24 with shaft 29 and grip (not shown), wheel 25 at heel end portion 27 and wheel 26 at toe end portion 28. Wheels 25 and 26 are attached to the putter body 23 using wheel axis means embodied by axles 34. The golf putter training tool 20 is similar to or the same as a conventional golf putter with the exception of the addition of the wheels 25 and 26, axles 34 and their attachment means to the putter body 23. The wheels 25 and 26 extend below the bottom surface 36 of the putter body 23 a set dimension to support the putter body 23 the desired distance above the golf course green surface. The wheels 25 and 26 rotate freely about their axles 34 to provide easy rolling across the green.

FIG. 5 is a front elevation view of the preferred embodiment of the golf putter training tool 20. Illustrated features of the golf putter training tool 20 include the putter body 23, handle 24, a wheel 25 on axle 34 at heel end portion 27 and a wheel 26 on another axle 34 at the toe end portion 28. The putter body 23 is supported at height C above the green 31 surface by the wheels 25 and 26. It is preferred that each such wheel be about ⅛" in thickness and ride clear about ⅛" away from the putter body.

The end elevation view of the golf putter training tool 20 is shown in FIG. 6. The outer circumference 37 of wheel 26 extending below the surface of bottom portion 36 of putter body 23. The wheel 26 (along with wheel 25, not shown), as stated, is free to rotate easily around axle 34. The wheels 25 and 26 position the putter body's 23 front putting portion 33 in the preferred relationship to the green for optimum contact with the golf ball.

With FIG. 7 is illustrated a partial cross-sectional view of one preferred embodiment of the golf putter training tool 20. Shown only is the wheel 26 and attachment means to the toe end portion 28 of the putter body 23 (although wheel 25 and attachment means to the heel end portion 27 are identical). The wheel 26 of this preferred embodiment is integral with the axle 34 and preferably constructed of steel or other suitable metal. The axle 34 consists of a round shaft 38 which is fitted into a round hole 39 into an end portion of the putter body 23 with suitable clearance to allow for free rotation. The round shaft 38 incorporates a retaining ring 40 which engages an annular groove 41 for retention of the axle 34 into the putter body 23. The retaining ring 40 could be of the split spring type to allow snap spring fit into the annular recess groove 41. The axle 34 with integral wheel 26 may be pulled outward from the round hole 39 to remove the wheel 26 from the putter body. After the golfer has practiced putting sufficiently to achieve necessary skill, the golfer may remove the wheels 25 and 26 to convert the golf putter training tool 20 to a conventional putter without wheels. Included on the axle 34 is a shoulder 42 for spacing the wheel 25 a suitable distance from the putter body 23.

FIG. 8 is a partial cross-sectional view of an alternate construction of the preferred embodiment of FIG. 7. In this case, as shown, the wheel 26 is separate from the axle 34. The axle 34 incorporates screw threads 43 which engage a threaded bole 44 in the end of the putter body 23. The axle 34 includes a straight shank 45 and head 46 with slot 47 (hex or other irregular shape) for inserting or removing the axle 34. Secured by the straight shank 45 and head 46 of the axle 34 is the inner diameter 48 of ball bearing 49. The outer diameter 50 of ball bearing 49 is permanently secured, bonded or molded to the wheel 26. The axle 34 and wheel 26 may be readily and easily removed or installed (in well-known ways) with the appropriate screwdriver or wrench.

FIG. 9 shows in a perspective view an alternate method of construction of the wheel portion of the preferred embodiment. As shown in prior views, the wheels 23 and 26 incorporate a surface on the outer circumference 37 which is smooth with rounded edges. An alternate outer circumference 37 would incorporate a toothed or knurled surface 31 having sharp portions 51' (see FIG. 10). According to a preferred embodiment of the present invention, the circumferential edge of wheels 25 and 26 should be constructed and arranged to impede during rotation other than straight line travel. It is preferred that each such circumferential edge comprise sharp portions constructed and arranged to partially embed each such wheel means in the putting surface. Thus the wheels will be assisted in straight tracking by "embedding" somewhat into the ground so that the wheels prefer to roll straight and not in an arc. In FIG. 10 is shown a partial side view of the alternate wheel shown in FIG. 9 with a toothed or knurled surface 51 on the outer circumference 37.

A sharp edge 52 on each side of the outer circumference 37 may be of benefit in preventing the wheels 25 and 26 from skidding sideways by digging into the turf of the green. In FIG. 11 is shown a perspective view of yet another preferred embodiment of wheels 25 and 26 having sharp edges 52 on both outer edges of the circumference of the wheel. Also shown in FIG. 11 are ball bearing 49 and axle 34 with screw threads 43 and slotted 47 head 46 as previously described in FIG. 8. The sharp edges 52 at the outer circumference 37 are further shown by a partial end view in FIG. 12.

FIG. 13 shows in a exploded perspective view an alternate construction which makes an efficient putter training device add-on for attaching wheels 25 and 26 to a putter body 23 without drilling or other modification of the putter body. In this alternate preferred embodiment, the putter body 23 does not have a round hole to receive an axle as previously described but instead the end face 53 (of an end portion of putter body 23) receives suction-cup means (of the type having a central axis) embodied by a conventional suction cup 54 which includes integral axle 34 along its central axis. The wheel (25 or 26), unlike previously described wheels, includes a hole 55 which slips on and freely rotates on axle 34. The wheel 25 or 26 may be retained by retaining ring 56 which engages in groove 57'. This alternate attachment method is shown assembled in the cross-section view of FIG. 14. This attachment means can be easily and readily installed or removed and can be used on conventional putters 58 with suitable end faces 53, i.e., end faces which are essentially vertical and in line with the proper putting motion heretofore described. As with the other preferred constructions herein disclosed, the radius of the wheel is larger (preferably by about ¼") than the distance from the bottom portion of the putter body to the axis of rotation of the wheel.

FIGS. 16 through 19 describe varied methods of simplifying, according to the illustrated preferred embodiments, the providing of the benefits of the present invention (even when the putter-body end faces are not smooth or vertical) by a putter training add-on without drilling or other modification to the putter body. As shown, there is provided a frame means embodied by the illustrated truck 57 which is situated along the bottom portion 36 of a conventional putter body 58. Truck 57, as shown, includes wheel axis means, embodied by axles 34, having the same single axis of rotation; and wheels 25 and 26, each having an essentially equal radius, are constructed and arranged to rotate about such axis of rotation. In a front view per FIG. 15 is shown a wheeled truck 57 which has wheels 25 and 26 and axles 34 at either end and is installed on conventional putter body 58. The truck 57, further illustrated in FIG. 16, incorporates a body 59 preferably made of spring steel which has spring tabs 60 at each end to firmly grip both the heel end portion 27 and toe end portion 28 of the putter. With the spring tabs 60 near the top corners of the putter the horizontal portion 61 of the wheeled truck 57 is held tightly against the surface of the putter body's bottom portion 36.

As an alternate construction of this embodiment, FIG. 17 shows a wheeled truck 57 which has the added features of holes 62 through the horizontal portion 61 to lighten the overall weight and further includes retaining tabs 63 to register against the front and rear surfaces adjacent the end portions of the putter body to give a tighter attachment. As a further alternate construction, FIG. 18 shows in perspective exploded view a wheeled truck 57 which does not use spring tabs for attachment to the putter 58 but instead is attached with VELCRO pads. On the bottom surface 36 are loop pads 64 which are permanently attached with adhesive or other suitable means. With the truck 57 not installed, the loop pads 64 do not hinder the conventional use of the putter. Permanently secured to the top surface of the horizontal portion 61 of the wheeled truck 57 are hook pads 65 to interface with and secure to the loop pads 64 of the putter.

As another preferred alternate construction, in FIG. 19 is shown a truck body 57 that is adjustable in length to accommodate putter bodies of varying lengths between their end portions. Here, the illustrated truck body 57 is composed of three sections including a center channel section 66 and end sections 67. The end sections 67 slide within the center channel section 66 to adjust to the required length. The fit between sections is tight to provide a reasonably-stable wheeled truck 57 to accept the putter. The tight interface between sections may be provided by friction fit or spring deformations 68 or other practical means. This adjustable wheeled truck 57 may be secured to the putter body by various means including spring tabs as previously described or VELCRO per FIG. 18.

It is especially noted that the rolling and supporting action of the wheel means of this invention, both in the putting backstroke and the putting stroke, contribute greatly to the training effect.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A golf putter training tool, for training a user's putting stroke along a putting surface, comprising, in combination:

a. golf putter means comprising
   i. golf putter shaft means; and
   ii. putter body means including a front putting portion, a bottom portion, and a pair of end portions;

b. connected to said putter body means and situate adjacent a first said end portion, first wheel means constructed and arranged to roll during a said putting stroke;

c. said golf putter training tool being constructed and arranged to assist a said user in making said putting stroke flat and in a straight line;

d. connected to said putter body means and situate adjacent a second said end portion, second wheel means constructed and arranged to roll during a said putting stroke;

e. wheel axis means having an axis of rotation;

f. said first wheel means and second wheel means both having a same radius and being constructed and arranged to rotate about said axis of rotation; and g. unitary frame means removably attachable to said putter body means, said first and second wheel means being attached to said unitary frame means;

h. wherein said radius of said first and second wheel means is larger than a distance from said bottom portion to said axis of rotation; and i. wherein said unitary frame means is removably attached to said putter body means by spring clip means.

2. A golf putter training tool, for training a user's putting stroke along a putting surface, comprising, in combination:

a. golf putter means comprising
   i. golf putter shaft means; and
   ii. putter body means including a front putting portion, a bottom portion, and a pair of end portions;

b. connected to said putter body means and situate adjacent a first said end portion, first wheel means constructed and arranged to roll during a said putting stroke;

c. said golf putter training tool being constructed and arranged to assist a said user in making said putting stroke flat and in a straight line;

d. connected to said putter body means and situate adjacent a second said end portion, second wheel means constructed and arranged to roll during a said putting stroke;

e. wheel axis means having an axis of rotation;

f. said first wheel means and second wheel means both having a same radius and being constructed and arranged to rotate about said axis of rotation; and g. unitary frame means removably attachable to said putter body means, said first and second wheel means being attached to said unitary frame means;

h. wherein said radius of said first and second wheel means is larger than a distance from said bottom portion to said axis of rotation; and i. wherein said unitary frame means is removably attached to said putter body means by hook-and-loop means.

3. A golf putter training tool, for training a user's putting stroke along a putting surface, comprising, in combination:

a. golf putter means comprising
   i. golf putter shaft means; and
   ii. putter body means including a front putting portion, a bottom portion, and a pair of end portions;

b. connected to said putter body means and situate adjacent a first said end portion, first wheel means constructed and arranged to roll during a said putting stroke;

c. said golf putter training tool being constructed and arranged to assist a said user in making said putting stroke flat and in a straight line;

d. connected to said putter body means and situate adjacent a second said end portion, second wheel means constructed and arranged to roll during a said putting stroke;

e. wheel axis means having an axis of rotation;

f. said first wheel means and second wheel means both having a same radius and being constructed and arranged to rotate about said axis of rotation; and g. unitary frame means removably attachable to said putter body means, said first and second wheel means being attached to said unitary frame means;

h. wherein said radius of said first and second wheel means is larger than a distance from said bottom portion to said axis of rotation; and i. wherein said unitary frame means is constructed and arranged to be selectively extensible to accommodate the distance from said first end portion of said putter body to said second end portion.

4. For use in training a user's putting stroke along a putting surface, a putter training device add-on, for attachment to putter body means including a front putting portion, a bottom portion, and a pair of end portions, said putter training device add-on comprising, in combination:

a. frame means constructed and arranged for attachment to said putter body means in such manner as to extend from a first of said end portions to a second of said end portions;

b. rotatably mounted to a first end of said frame means, first wheel means; and c. rotatably mounted to a second end of said frame means, second wheel means;

d. constructed and arranged so that, when said putter training device add-on is attached to a said putter body means, said first and second wheel means will roll during a said putting stroke;

e. wherein i. said frame means comprises wheel axis means having an axis of rotation, and ii. said first wheel means and second wheel means each having an essentially equal radius and being constructed and arranged to rotate about said axis of rotation;

f. constructed and arranged so that, when said putter training device add-on is attached to a said putter body means, said radius of said first and second wheel means is larger than a distance from said bottom portion of said putter body means to said axis of rotation;

g. wherein said frame means is constructed and arranged for attachment to said putter body means at each of said end portions.

5. For use in training a user's putting stroke along a putting surface, a putter training device add-on, for attachment to putter body means including a front putting portion, a bottom portion, and a pair of end portions, said putter training device add-on comprising, in combination:

a. frame means constructed and arranged for attachment to said putter body means in such manner as to extend from a first of said end portions to a second of said end portions;

b. rotatably mounted to a first end of said frame means, first wheel means; and c. rotatably mounted to a second end of said frame means, second wheel means;

d. constructed and arranged so that, when said putter training device add-on is attached to a said putter body means, said first and second wheel means will roll during a said putting stroke;

e. wherein i. said frame means comprises wheel axis means having an axis of rotation, and ii. said first wheel means and second wheel means each having an essentially equal radius and being constructed and arranged to rotate about said axis of rotation;

f. constructed and arranged so that, when said putter training device add-on is attached to a said putter body means, said radius of said first and second wheel means is larger than a distance from said bottom portion of said putter body means to said axis of rotation;

g. wherein said frame means is constructed and arranged for attachment to said putter body means along said bottom portion.

6. For use in training a user's putting stroke along a putting surface, a putter training device add-on, for attachment to putter body means including a front putting portion, a bottom portion, and a pair of end portions, said putter training device add-on comprising, in combination:

a. frame means constructed and arranged for attachment to said putter body means in such manner as to extend from a first of said end portions to a second of said end portions;

b. rotatably mounted to a first end of said frame means, first wheel means; and c. rotatably mounted to a second end of said frame means, second wheel means;

d. constructed and arranged so that, when said putter training device add-on is attached to a said putter body means, said first and second wheel means will roll during a said putting stroke;

e. wherein i. said frame means comprises wheel axis means having an axis of rotation, and ii. said first wheel means and second wheel means each having an essentially equal radius and being constructed and arranged to rotate about said axis of rotation;

f. constructed and arranged so that, when said putter training device add-on is attached to a said putter body means, said radius of said first and second wheel means is larger than a distance from said bottom portion of said putter body means to said axis of rotation;

g. wherein said frame means is constructed and arranged to be selectively extensible to accommodate the distance from said first end portion of said putter body to said second end portion.

7. For use in training a user's putting stroke along a putting surface, a putter training device add-on, for attachment to putter body means including a front putting portion, a bottom portion, and a pair of end portions, said putter training device add-on comprising, in combination:

a. suction-cup means, of the type having a central axis, for attaching said putter training device add-on to a said end portion of a said putter body means; and b. rotatably mounted to said suction-cup means about said central axis, wheel means.

8. A putter training device add-on according to claim 7 constructed and arranged so that, when said putter training device add-on is attached to a said putter body means, said radius of said wheel means is larger than a distance from said bottom portion of said putter body means to said central axis.

9. A golf putter training tool, for training a user's putting stroke along a putting surface, comprising, in combination:

a. golf putter means comprising
   i. golf putter shaft means; and
   ii. putter body means including a front putting portion, a bottom portion a smooth uninterrupted rear portion, and a pair of end portions;

b. connected to said putter body means and situate adjacent a first said end portion, first wheel means constructed and arranged to roll during a said putting stroke;

c. said golf putter training tool being constructed and arranged to assist a said user in making said putting stroke flat and in a straight line;

d. connected to said putter body means and situate adjacent a second said end portion, second wheel means constructed and arranged to roll during a said putting stroke;

e. wheel axis means having an axis of rotation;

f. said first wheel means and second wheel means both having a same radius and being constructed and arranged to rotate about said axis of rotation;

g. wherein said radius of said first and second wheel means is larger than a distance from said bottom portion to said axis of rotation; and h. non-destructive attachment means for removably attaching to said putter body means said first and second wheel means and said axis means without change, alteration or modification to said putter body means.

10. For use in training a user's putting stroke along a putting surface, a putter training device add-on, for attachment to putter body means including a front putting portion, a bottom portion a smooth uninterrupted rear portion, and a pair of end portions, said putter training device add-on comprising, in combination:

a. rotatably mounted on a first central axis, first wheel means constructed and arranged for positioning adjacent a first said end portion;

b. rotatably mounted on a second central axis, second wheel means constructed and arranged for positioning adjacent a second said end portion; and c. axis means constructed and arranged for providing the same said central axis for both said first and second wheel means;

d. non-destructive attachment means for removably attaching to said putter body means said first and second wheel means and said axis means without change, alteration or modification to said putter body means.

* * * * *